US007377369B2

(12) United States Patent
Mabillard

(10) Patent No.: US 7,377,369 B2
(45) Date of Patent: May 27, 2008

(54) BRAKE, VEHICLE AND ROLLER COASTER CIRCUIT

(75) Inventor: Claude Mabillard, Choëx (CH)

(73) Assignee: Bollinger & Mabillard Ingénieurs Conseils SA, Monthey (CH)

( * ) Notice: Subject to any disclaimer, the term of this patent is extended or adjusted under 35 U.S.C. 154(b) by 0 days.

(21) Appl. No.: 10/963,022

(22) Filed: Oct. 12, 2004

(65) Prior Publication Data

US 2005/0077125 A1 Apr. 14, 2005

(30) Foreign Application Priority Data

Oct. 14, 2003 (CH) ..... 1752/03

(51) Int. Cl.
*B60T 7/12* (2006.01)
*B61H 13/34* (2006.01)
*A63G 7/00* (2006.01)

(52) U.S. Cl. ..... 188/141; 188/144; 188/135; 188/34; 104/86

(58) Field of Classification Search ..... 188/135, 188/140 R, 141, 144, 153 R, 382, 155, 34; 303/1; 104/69, 70, 72, 73, 86, 249; 244/110 R, 244/112; 114/145 R, 151; 441/71, 79; 296/180.1–180
See application file for complete search history.

(56) References Cited

U.S. PATENT DOCUMENTS

| | | | | | |
|---|---|---|---|---|---|
| 871,643 | A * | 11/1907 | Shaw | 104/86 |
| 3,020,568 | A * | 2/1962 | Tierney | 441/71 |
| 3,167,024 | A | 1/1965 | Bacon et al. | |
| 3,229,312 | A * | 1/1966 | Smith | 441/71 |
| 3,255,472 | A * | 6/1966 | Thorne | 441/71 |
| 5,613,443 | A * | 3/1997 | Ariga et al. | 104/70 |
| 5,888,110 | A * | 3/1999 | Haller et al. | 441/71 |
| 6,409,555 | B1 * | 6/2002 | Plante et al. | 441/71 |

FOREIGN PATENT DOCUMENTS

| | | | | |
|---|---|---|---|---|
| CH | 689857 | A5 | 12/1999 | |
| DE | 3920284 | A1 * | 1/1991 | 188/382 |
| DE | 10160039 | C1 | 9/2003 | |

* cited by examiner

*Primary Examiner*—Thomas J Williams
(74) *Attorney, Agent, or Firm*—Clifford W. Browning; Krieg DeVault LLP

(57) ABSTRACT

A roller coaster circuit comprising a pool of water, which is run alongside or crossed, via a dry channel, by a train of vehicles provided laterally with water brakes consisting of a nozzle becoming immersed in the body of water and throwing the latter out in the form of upward sprays.

19 Claims, 3 Drawing Sheets

BRAKE, VEHICLE AND ROLLER COASTER CIRCUIT

The present invention concerns a roller coaster circuit vehicle brake, a vehicle equipped with such a brake and a roller coaster circuit comprising such a vehicle.

Amusement parks are experiencing an ever-increasing success in both the United States, where they originated, and the rest of the world. One of the most spectacular and most impressive attractions is that known by the name "roller coaster". These roller coasters comprise one or more vehicles constituting a train, running on the rails of a circuit, with steeply sloping portions of circuit. The passengers have a liking for this attraction for the strong impressions it gives. These impressions result to a great extent from the various sensations of acceleration given by the route; they also result from subjective impressions, namely feelings of vertigo, fear, illusion of the risk or surprise faced with the appearance of unexpected events, which the constructor tries to generate through the arrangement of the circuit.

The U.S. Pat. No. 3,167,024 describes a roller coaster circuit simulating a bobsleigh run, comprising a pool of water towards the end of the route, before the entry to the station. The rails cross the pool, under the surface of the water. The streamlined lower part of the vehicles enters the water during the crossing of the pool, which brakes them whilst raising a spray of water. This installation has several drawbacks: at the moment of the entry of the vehicle into the water, a shock is almost inevitable; at this moment and during the crossing of the pool, the resistance of the water exerts a force which has a large vertical component on the vehicle, which tends to separate the latter from the rails and which must be compensated for by the components of the undercarriage. The mechanical stresses to which the undercarriage is subjected are therefore particularly great with this system. The contact with the water tends to remove lubricating material from the bearings. The repeated shocks, as well as the corrosion due to frequent passing between water and air, tends to cause rapid wear of the undercarriage. In addition, at the slightest sealing defect of the body, the passengers in the vehicle risk being soaked.

The patent CH 689857 of the applicant describes a circuit which passes into a stretch of water, arranged so as to give the passengers an impression of splash-down. The level of the railway line in the stretch of water is below the water level. On account of the vehicles being designed to remain fixed to the rails, these vehicles are then partially submerged in the water, which causes on the one hand considerable braking and on the other hand large sprays of water. This section is followed by a small ramp in order to bring the train of vehicles to the level of the station. This circuit also poses the problems related to a specific design of vehicle having to withstand a very large number of entries in contact with the water in the pool.

One aim of the invention is to propose a roller coaster circuit in which the vehicles can benefit from the braking effect of a body of water, whilst avoiding the above-mentioned mechanical stresses on the equipment.

Another aim of the invention is to be able to generate sprays of water on a section of a circuit in order to benefit from the aesthetic effect and the psychological effect of surprise they cause in the passengers, whilst being in a position to adjust them in terms of height and/or intensity, in such a way that the passengers are not wet, or on the contrary are touched by the drops of water if the weather conditions so permit, and this can contribute to their amusement.

Another aim of the invention is to obtain this braking and these sprays of water without having to use vehicles with enclosing sealed bodies, whereas the trend in circuit construction is rather to vehicles open on all sides, which increase the sensations of the passengers.

These aims are achieved by virtue of a roller coaster circuit vehicle brake consisting of a nozzle curved in such a way that the fluid intake and the fluid ejection are oriented in different directions and fixing means for fixing the nozzle to the frame of a vehicle.

According to the invention, the brake is arranged on the vehicle in such a way that the fluid intake opening of the nozzle is oriented towards the front of the vehicle.

The term "front of the vehicle" means here the portion of space situated in front of the vehicle and not the components constituting the forward part of the vehicle.

The roller coaster circuit on which the vehicle runs comprises a stretch of water arranged in such a way that, when the vehicle crosses it or runs alongside it, the intake opening of the brake nozzle goes into the water but, preferably, the rails are not in contact with the water.

When the intake opening of the nozzle enters into the water, a relative motion occurs between the walls of the nozzle and the body of water which is momentarily situated inside. On account of the curvature of the nozzle, a component of this relative motion, in a direction different from that of the path of the vehicle, is imparted to the body of water which is momentarily situated inside the nozzle, through transfer of the kinetic energy of the vehicle to this body of water, thus braking the vehicle. At the output of the nozzle, a spray of water is sent in the direction in which this water is ejected from the nozzle, producing a fine visual effect.

Persons skilled in the art will understand that, if the nozzle were straight and oriented parallel to the path of the vehicle, the body of water through which the nozzle passed would be scarcely set in motion and that, if the nozzle were straight but oriented differently, at the time of entry into the water a shock effect and a violent mechanical stress tending to tear the nozzle off would be exerted on the fixing means.

The forward part of the nozzle, comprising the intake opening, and the rear part of the nozzle, comprising the ejection opening, can consist of one or more sections of pipe. This pipe or these sections of pipe can in particular be cylindrical, regular or irregular conical, or cylindro-conical. The forward part and the rear part are connected to one another by a portion of pipe with a bend in it.

The flow rate of water through the nozzle depends essentially on the cross-section of the intake opening and the speed of the vehicle. The cross-section of the ejection opening can be equal to the cross-section of the intake opening. If the cross-section of the ejection opening is smaller than the cross-section of the intake opening, the water has a higher speed at the output and the spray of water has a greater range. If the cross-section of the ejection opening is larger than the cross-section of the intake opening, the speed of the flow at the output is lower and the jet of water is shorter.

Preferably, the nozzle according to the invention is curved in such a way that the direction of the ejected jet of water deviates from the intake direction by an angle greater than 30°, and preferably greater than 50°, so that a large amount of kinetic energy is transferred from the vehicle to the water set in motion. With an angle of 90°, the range of the jet of water is a maximum. The angle at the top of the bend in the nozzle, generating the curvature thereof, is preferably between 30° and 180°.

The nozzle can be fixed to the frame of the vehicle by means of a set of bars and/or rods which makes it secured thereto, whilst making it possible to adjust the spacing of the nozzle with respect to the undercarriage of the vehicle.

Instead of a set of spacing bars, or in addition to such a set of bars, the means of fixing the nozzle to the frame of the vehicle can comprise a plate or a bodywork component in the form of a wing capable of forming a screen between the passengers in the vehicle and discharges of liquid, when the vehicle is crossing a stretch of water and the nozzle comes into operation. The fixing means, in the form of bars and/or plates, can moreover contribute towards rigidifying the structure of the nozzle.

The roller coaster circuit vehicle according to the invention preferably carries one or more pair(s) of such brakes, arranged laterally and symmetrically with respect to the longitudinal plane of symmetry of the vehicle.

The lateral arrangement of the brake with respect to the frame allows the brake to be brought into operation when the vehicle is running alongside a body of water provided for this purpose along its path. The symmetrical arrangement in pairs makes it possible to balance the braking forces during the interaction of each nozzle with bodies of water situated either side of the rails where the vehicle is running.

Preferably, the fluid ejection opening of the nozzles is oriented in an upward direction, with the aim of producing rising jets of water. This arrangement is not only aesthetic but, by a mechanical reaction effect, tends to press the vehicle against the rail instead of lifting it up, as was the case in the devices of the prior art. In particular, the axis of the forward part of a nozzle can be substantially parallel to the axis of the vehicle and the intake opening substantially perpendicular to this axis of the forward part; this opening can also be contained in a plane inclined with respect to the axis of the forward part in such a way that the upper edge of the intake opening is situated further forward than the lower edge of this opening.

In order that the frame itself, or the body of the vehicle, does not touch the surface of the stretch of water that the vehicle is crossing, the intake openings of the nozzles can be arranged by means of fixing means, at the height of the undercarriage of the vehicle, in particular at the height of the points of contact of this undercarriage with the rail of the circuit, or perhaps even lower. According to a preferred embodiment of the invention, on each side of a vehicle, the set of components constituting the undercarriage of the vehicle, the lower face of the frame of the vehicle and the components constituting the brake according to the invention delimit a free space, open towards the bottom. With this arrangement of the components of the vehicle, the brake according to the invention and the rest of the components of the vehicle can pass either side of a partition arranged along the rail. The corresponding roller coaster circuit can comprise a channel, consisting of two parallel separation walls, a stretch of water being arranged either side of the channel. The system of rails of the circuit follows this channel whilst remaining in the dry. The walls of the channel are arranged in such a way that their upper edges fit into the free space mentioned above, during the passage of the vehicle in the channel.

Other characteristics and advantages of the invention will emerge for persons skilled in the art from the detailed description of a preferred embodiment of the invention, referring to the figures of the drawing, in which FIG. 1 shows a lateral view in elevation of a brake according to the invention;

Figure 1:
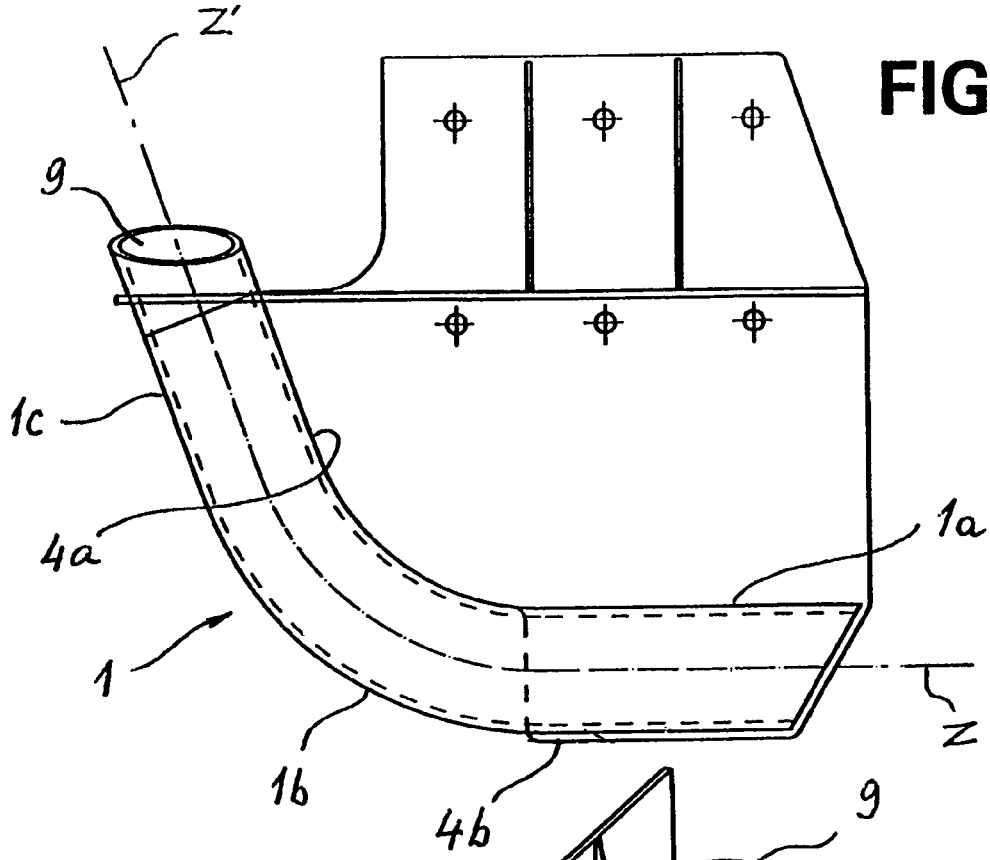
Figure 2:
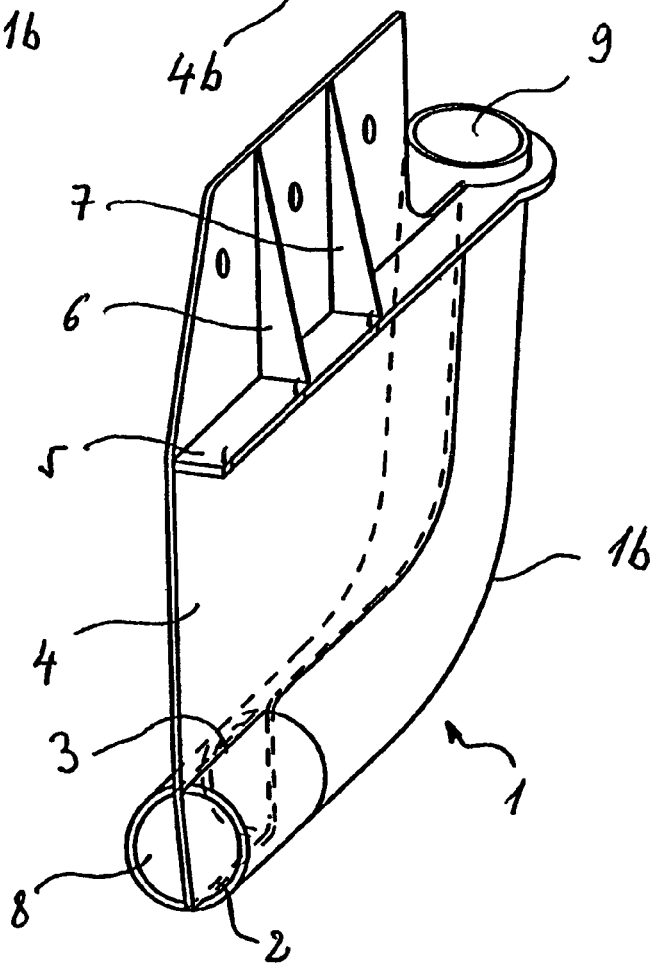
FIG. 2 shows a view in perspective of the same brake.

The nozzle 1 depicted in FIG. 1 and FIG. 2 consists of a pipe of cylindrical section, with a bend in its central part 1*b*. The end of the forward part 1*a*, defining the intake opening 8 of the nozzle, is cut slantwise with respect to the axis Z of this part of the pipe. The end of the rear part 1*c*, defining the fluid ejection opening 9, is also cut slantwise with respect to the axis Z' of this part of the pipe. The forward part 1*a* comprises two longitudinal incisions 2 and 3, diametrically opposite, and contained in the plane defined by the axes Z and Z'. The direction of the axis Z' deviates from the direction of the axis Z by an angle of approximately 70°, so that the angle at the top (Z, Z') is approximately 110°. The planes defining the openings 8 and 9 are perpendicular to the plane defined by Z and Z'.

The nozzle 1 can be fixed to a vehicle by means of a fixing plate 4. The plate 4 is approximately trapezoidal in its upper part and has six holes in it, allowing bolts to be accommodated. One side 4*a* of the lower part of the plate 4 has a rounded outline which fits the internal curve of the pipe constituting the nozzle 1. In the lower extension of the part 4*a*, the plate 4 comprises a protuberance 4*b*, itself trapezoidal in shape, whose dimensions are such that it goes into the slots 2 and 3 in the nozzle 1, going very slightly beyond the lower slot 2 and the opening 8 of the forward part 1*a*.

On one of the sides, the plate 4 comprises a reinforcing bar 5 and two longitudinal members 6 and 7 themselves reinforcing the assembly between the reinforcing bar 5 and the plate 4. One of the ends of the bar 5 comprises a cut-out of elliptical section gripping the rear part 1*c* of the nozzle 1 close to the ejection opening 9. All the components described above are made from steel and are welded to one another, forming a rigid structure.

Figure 4:
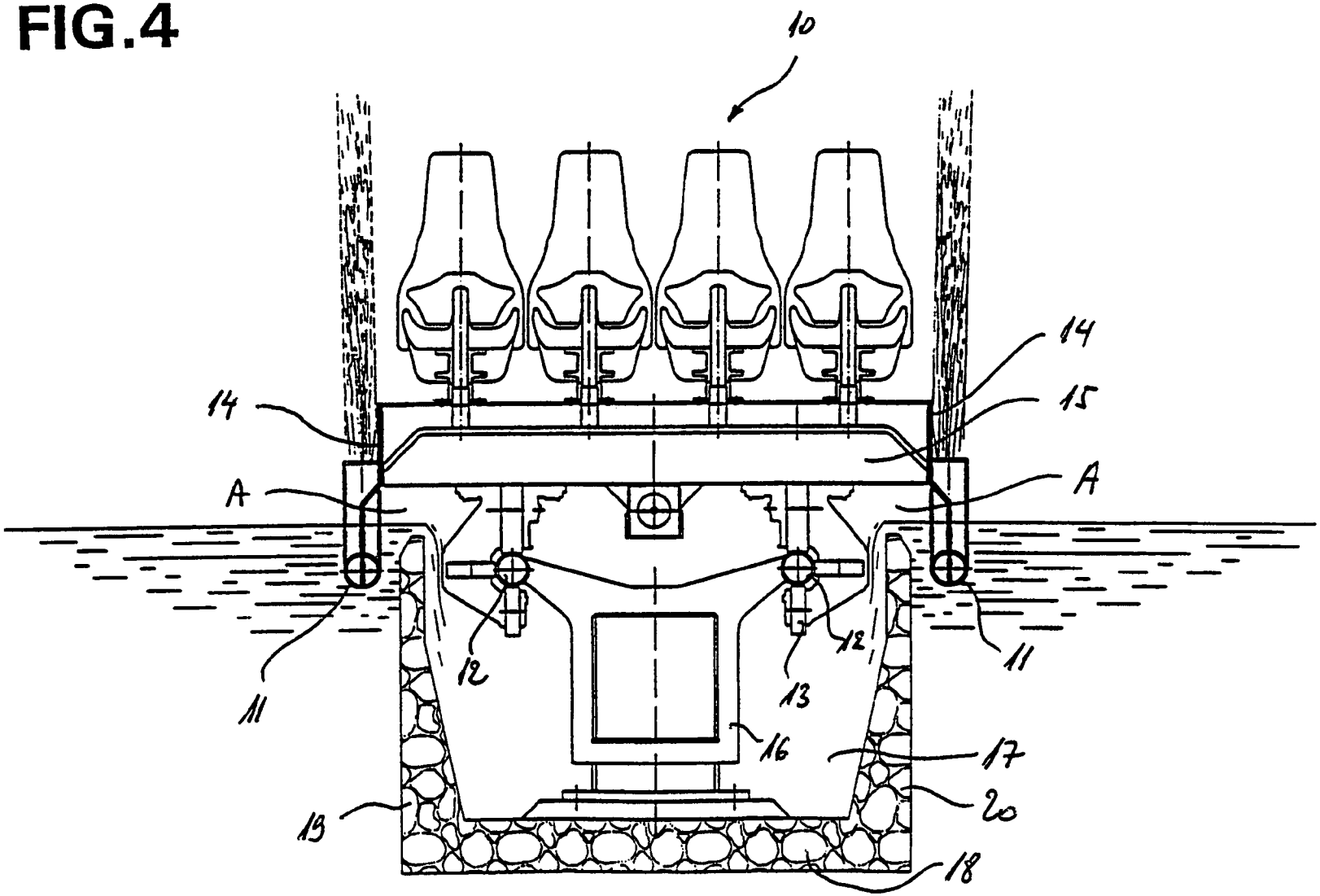
FIG. 4 is a cross-section of a vehicle along the plane XX' of FIG. 3.

FIG. 4 illustrates schematically the mounting of a pair of brakes on the frame of a roller coaster circuit vehicle. In FIG. 4, the fixing plate 14 is not flat as in FIG. 1, but takes the form of a bodywork wing consisting of two flat areas connected by a slantwise discontinuity in alignment. The plates 14 are bolted to each side of the frame 15. The nozzle 11 is similar to the nozzle 1 of FIG. 1 and 2. FIG. 4 shows schematically the rails 12 and the undercarriage 13 of the vehicle; the structure of such undercarriages 13 is known in other respects and does not form part of the present invention. It should be noted that, between the undercarriage 13, the lower face of the frame 15 and the plates 14, there is formed on each side a free space A which, seen in cross-section, forms overall an inverted U.

The rails 12 are attached to a steel structure 16, itself disposed in a channel 17 formed by a bottom 18 and two walls 19 and 20 made of masonry. The height and thickness of the wall 19, and the shape of the fixing plate 14, are chosen so that, when the vehicle 10 is running on the rails 12, the top of the wall 19 fits inside the space A without touching either the undercarriage 13, the bottom of the frame 15, or the plate 14 or nozzle 11 of the brake. Same arrangement applies to the wall 20.

A stretch of water is arranged either side of the walls 19 and 20, in such a way that the latter delimit between them a dry or almost dry channel 17: water can overflow over the top of the walls 19 and 20 and fill the bottom of the channel, giving from a distance the optical illusion that this is also filled with water. However, the circuit is arranged in such a way that the level of water in the channel 17 always remains distinctly lower than the level of the rails 12 so that, when the vehicle 10 follows this channel 17, the undercarriage 13 does not go into the water.

Figure 3:
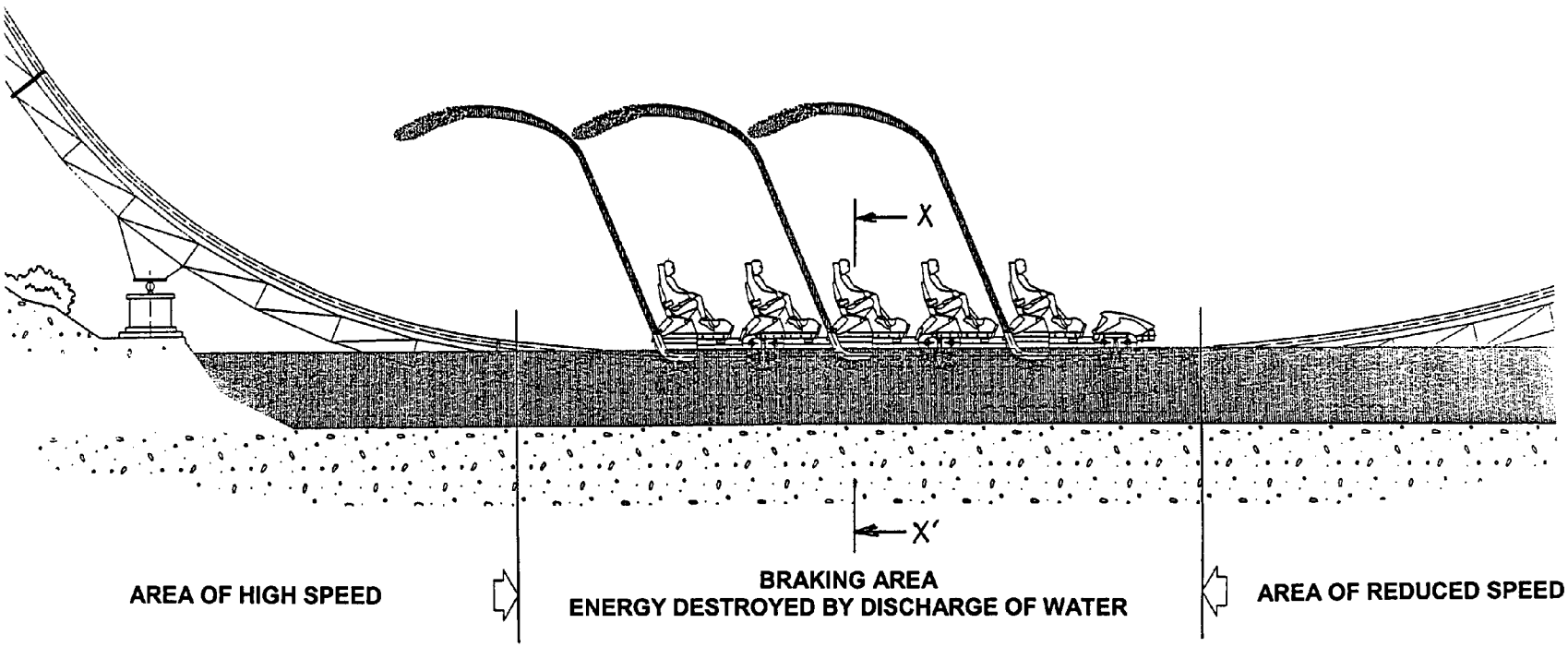
FIG. 3 is a lateral view of a train of vehicles crossing a stretch of water of a circuit.

FIG. 3 depicts schematically in a side view the crossing of the stretch of water by a train of vehicles carrying passengers. In the left-hand area, the vehicle arrives from a steeply sloping part and is endowed with a high speed. The curvature of the rails is such that the forward part of the nozzles goes into the water practically tangentially, that is to say almost parallel to the axis Z. The central part of FIG. 3 shows the braking area, in which the movement of the vehicles generates a motion of the body of water passing through the nozzles. As a result of the curvature of the nozzles, the body of water, initially at rest, undergoes an acceleration upwards and is ejected at high speed, as illustrated in FIG. 3. The vehicle thus loses kinetic energy, used to produce sprays of water which surround it on either side, so that it leaves the channel of the stretch of water at reduced speed.

In FIGS. 3 and 4, the axes of the rear parts of the nozzles are situated in a vertical plane and are slightly inclined towards the rear, so that the sprays of water are situated overall in a vertical plane and directed towards the rear of the vehicle. Persons skilled in the art will understand that, by virtue of other orientations of the rear part of the nozzles, the sprays of water can be oriented in all desired directions. The sprays of water can be directed in particular laterally outwards, on either side, so that the passengers absolutely do not risk being wet. On the contrary, in particular during summer operation of the amusement park, the nozzles can be oriented in such a way that the sprays of water form temporary arches over the train of vehicles.

The invention claimed is:

1. A roller coaster circuit, characterized in that it comprises at least one vehicle comprising at least two brakes consisting of a nozzle curved in such a way that a fluid intake and a fluid ejection are oriented in different directions and of fixing means for fixing the nozzle to a frame of a vehicle, arranged in such a way that the fluid intake opening of the nozzle is oriented towards the front of the vehicle, said circuit being characterized by the presence of a stretch of water arranged in such a way that the intake openings of the nozzle of the brake of the vehicle goes into the water when the vehicle crosses or runs alongside said stretch of water and in that said stretch of water comprises a channel arranged inside said stretch of water and delimited by two parallel separation walls, thereby delimiting a dry or almost dry channel between said separation walls, in that a railway line of the circuit follows said channel, and in that the level of water in said channel is sufficiently low for an undercarriage of the vehicle to not touch the water, said brakes being situated outside said channel, respectively on each side of said channel.

2. A circuit according to claim 1, characterized in that a forward part of the nozzle comprising the intake opening and a rear part of the nozzle comprising the ejection opening consist of one or more pipes, preferably chosen from amongst cylindrical, regular or irregular conical, and cylindro-conical pipes, and are connected to one another by a portion of pipe with a bend in it.

3. A circuit according to claim 1, characterized in that an ejection direction of the nozzle deviates from an intake direction by an angle greater than 30°, and in that preferably the angle at a top of the bend is between 30° and 180° C.

4. A circuit according to claim 1, characterized in that said means of fixing the nozzle to the frame of the vehicle comprise a set of bars and/or rods and/or plates making it possible to adjust the spacing of the nozzle with respect to the undercarriage of the vehicle.

5. A circuit according to claim 1, characterized in that said means of fixing the nozzle to the frame of the vehicle comprise a bodywork component in the form of a wing capable of forming a screen between passengers in the vehicle and discharges of liquid.

6. A circuit according to claim 1, characterized in that said fixing means comprise one or more fixing plates, arranged so as to rigidify the structure of the nozzle.

7. A circuit according to claim 1, characterized in that the intake opening of the nozzle is arranged at the height of the undercarriage of the vehicle, in particular substantially at the height of the points of contact with the rails of the circuit.

8. A circuit according to claim 1, characterized in that said means of fixing the nozzle to the frame of the vehicle comprise a set of bars and/or rods and/or plates making it possible to adjust the spacing of the nozzle with respect to an undercarriage of the vehicle and in that said means of fixing the nozzle to the frame of the vehicle comprise a bodywork component in the form of a wing capable of forming a screen between passengers in the vehicle and discharges of liquid.

9. A circuit according to claim 1, characterized in that the frame of the vehicle carries, on an upper face, seats for passengers, and, on a lower face, the undercarriage for guiding the vehicle on rails, wherein at least one pair of brakes is arranged laterally of the vehicle and symmetrically with respect to the longitudinal plane of symmetry of the vehicle, the brakes each comprising a nozzle curved in such a way that a fluid intake opening and a fluid ejection opening are oriented in different directions and fixing means for fixing the brakes to the vehicle, the nozzle comprising one or more pipes, preferably chosen from amongst cylindrical, regular or irregular conical, and cylindro-conical pipes, connected to one another by a portion of pipe with a bend in it, wherein the nozzle is arranged in such a way that the fluid intake opening of the nozzle is situated below the lower face of the frame, when the vehicle is viewed in a horizontal position, and oriented towards the front of the vehicle and in that the fluid ejection openings of the nozzles being oriented in upward directions.

10. A roller coaster circuit, characterized in that it comprises at least one vehicle comprising at least one brake consisting of a nozzle curved in such a way that a fluid intake and a fluid ejection are oriented in different directions and of fixing means for fixing the nozzle to a frame of a vehicle, arranged in such a way that the fluid intake opening of the nozzle is oriented towards the front of the vehicle, said circuit being characterized by the presence of a stretch of water arranged in such a way that the intake openings of the nozzle of the brake of the vehicle goes into the water when the vehicle crosses or runs alongside said stretch of water and in that said stretch of water comprises a channel, delimited by two parallel separation walls, in that a railway line of the circuit follows said channel, and in that the level of water in said channel is sufficiently low for an undercarriage of the vehicle to not touch the water, said circuit being further characterized in that rail supports in said channel and the walls of said channel are arranged in such a way that the upper edges of said separation walls fit, during the passage of said vehicle in said channel, into a free space formed between the set of components constituting the undercarriage of the vehicle, a lower face of the frame of the vehicle and the components constituting said brakes.

11. A circuit according to claim 10, characterized in that a forward part of the nozzle comprising the intake opening and a rear part of the nozzle comprising the ejection opening consist of one or more pipes, preferably chosen from amongst cylindrical, regular or irregular conical, and cylindro-conical pipes, and are connected to one another by a portion of pipe with a bend in it.

12. A circuit according to claim 10, characterized in that an ejection direction of the nozzle deviates from an intake direction by an angle greater than 30°, and in that preferably the angle at a top of the bend is between 30° and 180° C.

13. A circuit according to claim 10, characterized in that said means of fixing the nozzle to the frame of the vehicle comprise a set of bars and/or rods and/or plates making it possible to adjust the spacing of the nozzle with respect to the undercarriage of the vehicle.

14. A circuit according to claim 10, characterized in that said means of fixing the nozzle to the frame of the vehicle comprise a bodywork component in the form of a wing capable of forming a screen between passengers in the vehicle and discharges of liquid.

15. A circuit according to claim 10, characterized in that said fixing means comprise one or more fixing plates, arranged so as to rigidify the structure of the nozzle.

16. A circuit according to claim 10, characterized in that the vehicle comprises one or more pairs of brakes arranged laterally with the frame and symmetrically with respect to the longitudinal plane of symmetry of the vehicle, the fluid ejection openings of the nozzles being oriented in upward directions.

17. A circuit according to claim 10, characterized in that the intake opening of the nozzle is arranged at the height of the undercarriage of the vehicle, in particular substantially at the height of the points of contact with the rails of the circuit.

18. A circuit according to claim 10, characterized in that the frame of the vehicle carries, on an upper face, seats for passengers, and, on a lower face, the undercarriage for guiding the vehicle on rails, wherein at least one pair of brakes is arranged laterally of the vehicle and symmetrically with respect to the longitudinal plane of symmetry of the vehicle, the brakes each comprising a nozzle curved in such a way that a fluid intake opening and a fluid ejection opening are oriented in different directions and fixing means for fixing the brakes to the vehicle, the nozzle comprising one or more pipes, preferably chosen from amongst cylindrical, regular or irregular conical, and cylindro-conical pipes, connected to one another by a portion of pipe with a bend in it, wherein the nozzle is arranged in such a way that the fluid intake opening of the nozzle is situated below the lower face of the frame, when the vehicle is viewed in a horizontal position, and oriented towards the front of the vehicle and in that the fluid ejection openings of the nozzles being oriented in upward directions.

19. A circuit according to claim 10, characterized in that said means of fixing the nozzle to the frame of the vehicle comprise a set of bars and/or rods and/or plates making it possible to adjust the spacing of the nozzle with respect to an undercarriage of the vehicle and in that said means of fixing the nozzle to the frame of the vehicle comprise a bodywork component in the form of a wing capable of forming a screen between passengers in the vehicle and discharges of liquid.

* * * * *